US006920992B2

(12) United States Patent
Lane et al.

(10) Patent No.: US 6,920,992 B2
(45) Date of Patent: Jul. 26, 2005

(54) INVERTING VACUUM PANELS FOR A PLASTIC CONTAINER

(75) Inventors: Michael T. Lane, Brooklyn, MI (US); Richard J. Steih, Britton, MI (US); Daniel W. Gamber, Tecumseh, MI (US); Randall S. Brown, Kennesaw, GA (US)

(73) Assignee: Amcor Limited, Abbotsford (AU)

( * ) Notice: Subject to any disclaimer, the term of this patent is extended or adjusted under 35 U.S.C. 154(b) by 59 days.

(21) Appl. No.: 10/361,356

(22) Filed: Feb. 10, 2003

(65) Prior Publication Data

US 2004/0155008 A1 Aug. 12, 2004

(51) Int. Cl.[7] ..... B65D 1/02; B65D 1/46

(52) U.S. Cl. ..... 215/381; 215/383; 220/675

(58) Field of Search ..... 215/381–383, 215/384; 220/609, 666, 669, 674, 675, 771

(56) References Cited

U.S. PATENT DOCUMENTS

| | | | | | |
|---|---|---|---|---|---|
| 3,325,031 | A | | 6/1967 | Singier | |
| 4,805,788 | A | * | 2/1989 | Akiho | 215/381 |
| 4,863,046 | A | * | 9/1989 | Collette et al. | 215/381 |
| 5,060,453 | A | | 10/1991 | Alberghini et al. | |
| 5,141,121 | A | | 8/1992 | Brown et al. | |
| 5,178,289 | A | * | 1/1993 | Krishnakumar et al. | 215/382 |
| 5,199,588 | A | * | 4/1993 | Hayashi | 215/381 |
| 5,238,129 | A | * | 8/1993 | Ota | 215/381 |
| 5,303,834 | A | | 4/1994 | Krishnakumar et al. | |
| 5,337,909 | A | * | 8/1994 | Vailliencourt | 215/381 |
| 5,472,105 | A | * | 12/1995 | Krishnakumar et al. | 215/384 |
| 5,499,730 | A | * | 3/1996 | Harbour | 215/382 |
| 5,690,244 | A | | 11/1997 | Darr | |
| 5,810,195 | A | * | 9/1998 | Sim | 220/674 |
| 5,908,128 | A | | 6/1999 | Krishnakumar et al. | |
| 5,971,184 | A | | 10/1999 | Krishnakumar et al. | |
| 6,044,996 | A | | 4/2000 | Carew et al. | |
| 6,044,997 | A | * | 4/2000 | Ogg | 215/381 |
| 6,273,282 | B1 | * | 8/2001 | Ogg et al. | 215/381 |
| 6,494,333 | B2 | * | 12/2002 | Sasaki et al. | 215/384 |
| 6,497,333 | B1 | * | 12/2002 | Ellis et al. | 215/383 |
| 6,513,669 | B2 | * | 2/2003 | Ozawa et al. | 215/381 |
| 2002/0008077 | A1 | * | 1/2002 | Lane et al. | |
| 2004/0050851 | A1 | * | 3/2004 | Ilzuka et al. | |

FOREIGN PATENT DOCUMENTS

| | | | | |
|---|---|---|---|---|
| JP | 05065158 A | * | 3/1993 | B65D/1/02 |
| JP | 05310239 A | * | 11/1993 | B65D/1/02 |
| WO | WO 00/50309 | | 8/2000 | |
| WO | WO 00/68095 | | 11/2000 | |

* cited by examiner

*Primary Examiner*—Sue A. Weaver
(74) *Attorney, Agent, or Firm*—Harness, Dickey & Pierce, P.L.C.

(57) ABSTRACT

A sidewall portion of a plastic container adapted for vacuum pressure absorption. The sidewall portion including generally rectangular shaped vacuum panels equidistantly spaced about the container The vacuum panels being defined in at least part by an upper portion, a central portion and a lower portion formed in a compound curve shape. The vacuum panels being moveable to accommodate vacuum forces generated within the container thereby decreasing the volume of the container.

19 Claims, 5 Drawing Sheets

132
38
36
48
60
138
134
62
36
58
138
134
64
38
36
48
18

132
38
36
48
60
138
134
62
36
58
138
134
64
38
36
48
18

INVERTING VACUUM PANELS FOR A PLASTIC CONTAINER

TECHNICAL FIELD OF THE INVENTION

This invention generally relates to side panels for plastic containers which retain a commodity, and in particular a liquid commodity. More specifically, this invention relates to inverting vacuum panels formed in a plastic container that allow for significant absorption of vacuum pressures without unwanted deformation in other portions of the container.

BACKGROUND OF THE INVENTION

Numerous commodities previously supplied in glass containers are now being supplied in plastic containers, more specifically polyester and even more specifically polyethylene terephthalate (PET) containers. Manufacturers and fillers, as well as consumers, have recognized that PET containers are lightweight, inexpensive, recyclable and manufacturable in large quantities.

Manufacturers currently supply PET containers for various liquid commodities, such as beverages. Often these liquid products, such as juices and isotonics, are filled into the containers while the liquid product is at an elevated temperature, typically 68° C.–96° C. (155° F.–205° F.) and usually about 85° C. (185° F.). When packaged in this manner, the hot temperature of the liquid commodity is used to sterilize the container at the time of filling. This process is known as hot filling. The containers designed to withstand the process are known as hot fill or heat set containers.

Hot filling is an acceptable process for commodities having a high acid content. Non-high acid content commodities, however, must be processed in a different manner. Nonetheless, manufacturers and fillers of non-high acid content commodities desire to supply their commodities in PET containers as well.

For non-high acid commodities, pasteurization and retort are the preferred sterilization process. Pasteurization and retort both present an enormous challenge for manufactures of PET containers in that heat set containers cannot withstand the temperature and time demands required of pasteurization and retort.

Pasteurization and retort are both processes for cooking or sterilizing the contents of a container after it has been filled. Both processes include the heating of the contents of the container to a specified temperature, usually above about 70° C. (about 155° F.), for a specified length of time (20–60 minutes). Retort differs from pasteurization in that higher temperatures are used, as is an application of pressure externally to the container. The pressure applied externally to the container is necessary because a hot water bath is often used and the overpressure keeps the water, as well as the liquid in the contents of the container, in liquid form, above their respective boiling point temperatures.

PET is a crystallizable polymer, meaning that it is available in an amorphous form or a semi-crystalline form. The ability of a PET container to maintain its material integrity is related to the percentage of the PET container in crystalline form, also known as the "crystallinity" of the PET container. The percentage of crystallinity is characterized as a volume fraction by the equation:

$$\%\ \text{Crystallinity} = \frac{\rho - \rho_a}{\rho_c - \rho_a} \times 100$$

where ρ is the density of the PET material; $\rho_a$ is the density of pure amorphous PET material (1.333 g/cc); and $\rho_c$ is the density of pure crystalline material (1.455 g/cc).

The crystallinity of a PET container can be increased by mechanical processing and by thermal processing. Mechanical processing involves orienting the amorphous material to achieve strain hardening. This processing commonly involves stretching a PET preform along a longitudinal axis and expanding the PET preform along a transverse or radial axis to form a PET container. The combination promotes what is known as biaxial orientation of the molecular structure in the container. Manufacturers of PET containers currently use mechanical processing to produce PET containers having about 20% crystallinity in the container's sidewall.

Thermal processing involves heating the material (either amorphous or semi-crystalline) to promote crystal growth. On amorphous material, thermal processing of PET material results in a spherulitic morphology that interferes with the transmission of light. In other words, the resulting crystalline material is opaque, and thus, generally undesirable. Used after mechanical processing, however, thermal processing-results in higher crystallinity and excellent clarity for those portions of the container having biaxial molecular orientation. The thermal processing of an oriented PET container, which is known as heat setting, typically includes blow molding a PET preform against a mold heated to a temperature of about 120° C.–130° C. (about 248° F.–266° F.), and holding the blown container against the heated mold for about three (3) seconds. Manufacturers of PET juice bottles, which must be hot filled at about 85° C. (185° F.), currently use heat setting to produce PET bottles having an overall crystallinity in the range of 25–30%.

After being hot filled, the heat set containers are capped and allowed to reside at generally about the filling temperature for approximately five (5) minutes. The container, along with the product, is then actively cooled so that the filled container may be transferred to labeling, packaging and shipping operations. Upon cooling, the volume of the liquid in the container is reduced. This product shrinkage phenomenon results in the creation of a vacuum within the container. Generally, vacuum pressures within the container range from 1–300 mm Hg less than atmospheric pressure (i.e., 759 mm Hg–460 mm Hg). If not controlled or otherwise accommodated, these vacuum pressures result in deformation of the container which leads to either an aesthetically unacceptable container or one which is unstable.

In many instances, container weight is correlated to the amount of the final vacuum present in the container after this fill, cap and cool down procedure. In order to reduce container weight, i.e., "lightweight" the container, thus providing a significant cost savings from a material standpoint, the amount of the final vacuum must be reduced. Typically, the amount of the final vacuum can be reduced through various processing options such as the use of nitrogen dosing technology, minimize head space or reduce fill temperatures. One drawback with the use of nitrogen dosing technology however is that the minimum line speeds achievable with the current technology is limited to roughly 200 containers per minute. Such slower line speeds are seldom acceptable. Additionally, the dosing consistency is not yet at a technological level to achieve efficient operations. Minimizing head space requires more precession during filling, again resulting in slower line speeds. Reducing fill temperatures limits the type of commodity capable of being used and thus is equally disadvantageous.

Vacuum pressures have typically been accommodated by the incorporation of structures in the sidewall of the container. These structures are commonly known as vacuum panels. Traditionally, these paneled areas have been semi-rigid by design, unable to accommodate the high levels of vacuum pressures currently generated, particularly in lightweight containers.

Thus, there is a need for an improved sidewall of a container which is designed to distort inwardly in a controlled manner under the vacuum pressures which result from hot filling so as to accommodate these vacuum pressures and eliminate undesirable deformation in the sidewall of the container yet which allows for lightweighting, accommodates higher fill temperatures and is capable of reducing panel surface area. It is therefore an object of this invention to provide such a container sidewall.

SUMMARY OF THE INVENTION

Accordingly, this invention provides for inverting vacuum panels for a plastic container which maintain aesthetic and mechanical integrity during any subsequent handling after being hot filled and cooled to ambient having a structure that is designed to distort inwardly in a controlled manner so as to allow for significant absorption of vacuum pressures without unwanted deformation.

The present invention includes a sidewall portion of a plastic container, the container having an upper portion, the sidewall portion and a base. The upper portion includes an opening defining a mouth of the container. The sidewall portion extends from the upper portion to the base. The sidewall portion includes generally rectangular shaped vacuum panels defined in at least part by an upper portion, a central portion and a lower portion. The vacuum panels being moveable to accommodate vacuum forces generated within the container thereby decreasing the volume of the container.

Additional benefits and advantages of the present invention will become apparent to those skilled in the art to which the present invention relates from the subsequent description of the preferred embodiment and the appended claims, taken in conjunction with the accompanying drawings.

DETAILED DESCRIPTION OF THE PREFERRED EMBODIMENT

Figure 1:
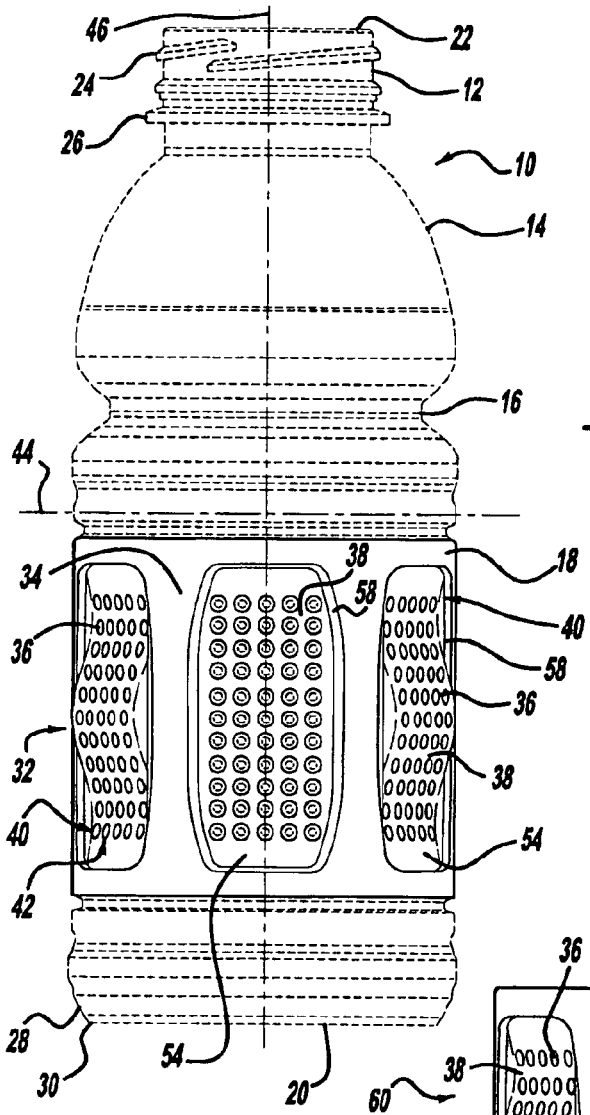
FIG. 1 is an environmental view of inverting vacuum panels constructed in accordance with the teachings of a preferred embodiment of the present invention and shown as formed on a sidewall portion of a plastic container.
Figure 2:
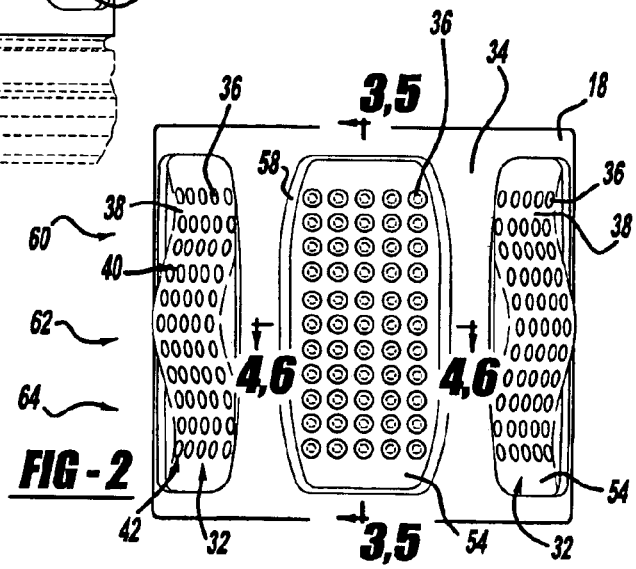
FIG. 2 is an elevational view of one of the inverting vacuum panels of FIG. 1 further illustrating the present invention.

The following description of the preferred embodiment is merely exemplary in nature, and is in no way intended to limit the invention or its application or uses.

As discussed above, to accommodate vacuum forces during cooling of the contents within a heat set container, containers have been provided with a series of vacuum panels around their sidewalls. Traditionally, these vacuum panels have been semi-rigid and incapable of preventing unwanted distortion elsewhere in the container, particularly in lightweight containers.

Referring now to the drawings, there is depicted a sidewall portion of a plastic container embodying the concepts of the present invention. The sidewall portion of the present invention is generally identified in the drawings with reference numeral 18 and is shown through the drawings adapted to cooperate with a specific plastic container 10. However, the teachings of the present invention are more broadly applicable to sidewall portions for a large range of plastic containers.

Prior to addressing the construction and operation of the sidewall portion 18 of the present invention, a brief understanding of the exemplary plastic container 10 shown in the drawings is warranted. The environmental view of FIG. 1 illustrates the plastic container 10 of the present invention including a finish 12, a shoulder region 14, a waist segment 16, the sidewall portion 18 and a base 20. The plastic container 10 has been specifically designed for retaining a commodity during a thermal process, such as a high-temperature pasteurization or retort. The plastic container 10 may be used for retaining a commodity during other thermal processes as well.

The plastic container 10 of the present invention is a blow molded, biaxially oriented container with an unitary construction from a single or multi-layer material such as polyethylene terephthalate (PET) resin. Alternatively, the plastic container 10 may be formed by other methods and from other conventional materials including, for example, polyethylene napthalate (PEN), and a PET/PEN blend or copolymer. Plastic containers blow molded with an unitary construction from PET materials are known and used in the art of plastic containers, and their general manufacture in the present invention will be readily understood by a person of ordinary skill in the art.

The finish 12 of the plastic container 10 includes a portion defining an aperture or mouth 22, a threaded region 24 and a support ring 26. The aperture 22 allows the plastic container 10 to receive a commodity while the threaded region 24 provides a means for attachment of a similarly threaded closure or cap (not shown). Alternatives may include other suitable devices which engage the finish 12 of the plastic container 10. Accordingly, the closure or cap (not shown) functions to engage with the finish 12 so as to preferably provide a hermetical seal for the plastic container 10. The closure or cap (not shown) is preferably made from a plastic or metal material conventional to the closure industry and suitable for subsequent thermal processing, including high temperature pasteurization and retort. The support ring 26 may be used to carry or orient the preform (the precursor to the plastic container 10) (not shown) through and at various stages of manufacture. For example, the preform may be carried by the support ring 26, the support ring 26 may be used to aid in positioning the preform in the mold, or the support ring 26 may be used by an end consumer to carry the plastic container 10.

Integrally formed with the finish 12 and extending downward therefrom is the shoulder region 14. The shoulder region 14 merges into the waist segment 16. The waist segment 16 provides a transition between the shoulder region 14 and the sidewall portion 18. The sidewall portion 18 extends downward from the waist segment 16 to the base 20. Because of the specific construction of the sidewall portion 18, a significantly lightweight container can be formed. Such a container 10 can exhibit at least a 10% reduction in weight from those of current stock containers. Such a container 10 is also capable of accommodating high fill temperatures and reduced panel surface area.

The base 20 of the plastic container 10, which extends inward from the sidewall portion 18, generally includes a chime 28 and a contact ring 30. The contact ring 30 is itself that portion of the base 20 which contacts a support surface upon which the container 10 is supported. As such, the contact ring 30 may be a flat surface or a line of contact generally circumscribing, continuously or intermittently, the base 20. The base 20 functions to close off the bottom portion of the plastic container 10 and, together with the shoulder region 14, the waist segment 16 and the sidewall portion 18, to retain the commodity.

The plastic container 10 is preferably heat set according to the above mentioned process or other conventional heat set processes. To accommodate vacuum forces, the sidewall portion 18 of the present invention adopts a novel and innovative construction. Generally, the sidewall portion 18 of the present invention includes vacuum panels 32 formed therein. As illustrated in the figures, the vacuum panels 32 are generally rectangular in shape and are shown as being generally equidistantly spaced around the sidewall portion 18 of the container 10. While such spacing is preferred, other factors such as labeling requirements or the incorporation of grip features into the container may require a spacing other than equidistant. The container illustrated in FIG. 1 shows a container 10 having six (6) vacuum panels 32. It is equally contemplated that less than this amount, such as three (3) vacuum panels 32, be required. Defined between adjacent vacuum panels 32 are lands or columns 34. Lands or columns 34 provide structural support and rigidity to the sidewall portion 18 of the container 10.

As shown in FIGS. 1–6, the vacuum panels 32 of the present invention include a series of indents or dimples 36 formed therein and throughout the vacuum panels 32. Viewed in elevation, the indents 36 are generally circular in shape. The area defined between adjacent indents 36 are lands 38. As illustrated, in the preferred embodiment, the indents 36 are generally spaced equidistantly apart from one another, and arranged in horizontal rows 40 and vertical columns 42. The horizontal rows 40 of indents 36 are generally seen as being parallel to a radial axis 44 of the container 10, while the vertical columns 42 of indents 36 are generally seen as being parallel to a central longitudinal axis 46 of the container 10. While the above described geometry of indents 36 is the preferred embodiment, it will be readily understood by a person of ordinary skill in the art that other geometrical arrangements are similarly contemplated. Such alternative geometrical arrangements may increase the amount of absorption.

Continuing with FIGS. 3–6, the indents 36, when viewed in cross section, are generally in the shape of a truncated or rounded cone having a lower most surface or point 48 and side surfaces 50. Side surfaces 50 are generally planar and slope inward toward the central longitudinal axis 46 of the container 10. The exact shape of the indents 36 can vary greatly depending on various design criteria. An indent 36 depth dimension 52 between the lower most surface or point 48 of the indents 36 and an underlying surface 54 of the vacuum panel 32 is equal to a dimension 56 measuring the length of indents 36.

The wall thickness of the vacuum panel 32 must be thin enough to allow the vacuum panel 32 to be flexible and function properly. Accordingly, the material thickness at the lower most surface or point 48 of the indents 36 is greater than the material thickness at the lands 38. Typically, the wall thickness of the lower most surface or point 48 is approximately between about 0.005 inches (0.127 mm) to about 0.015 inches (0.381 mm), while the wall thickness of the lands 38 is approximately between about 0.004 inches (0.102 mm) to about 0.014 inches (0.356 mm).

Vacuum panels 32 also include, and are surrounded by, a perimeter wall or edge 58. The perimeter wall or edge 58 defines the transition between the sidewall portion 18 and the underlying surface 54, and is an upstanding wall approximately 0 inches (0 mm) to approximately 0.25 inches (6.35 mm) in height. Accordingly, the depth of the vacuum panel 32 is approximately 0 inches (0 mm) to approximately 0.25 inches (6.35 mm). As is illustrated in the figures, the perimeter wall or edge 58 is shorter at the center of the vacuum panel 32 and is taller at the top and bottom of the vacuum panel 32. It should be noted that the perimeter wall or edge 58 is a distinctly identifiable structure between the sidewall portion 18 and the underlying surface 54. The perimeter wall or edge 58 provides strength to the transition between the sidewall portion 18 and the underlying surface 54. This transition must be abrupt in order to maximize the local strength as well as to form a geometrically rigid structure. The resulting localized strength increases the resistance to creasing in the sidewall portion 18.

Figure 3:
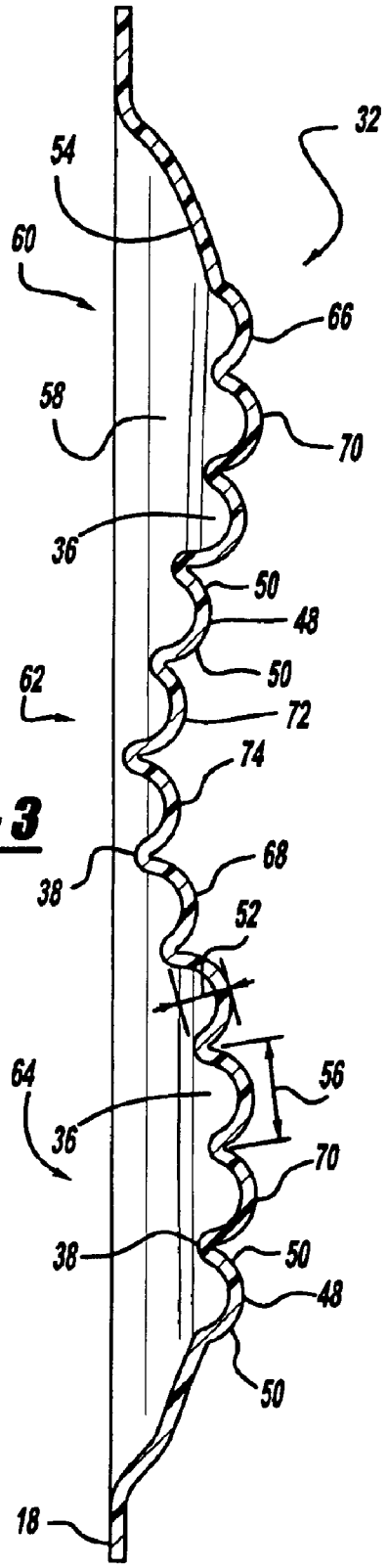
FIG. 3 is a cross-sectional view of the inverting vacuum panel, taken generally along the line 3—3 of FIG. 2, the inverting vacuum panel shown as formed on the container sidewall, the container as molded and empty.
Figure 4:
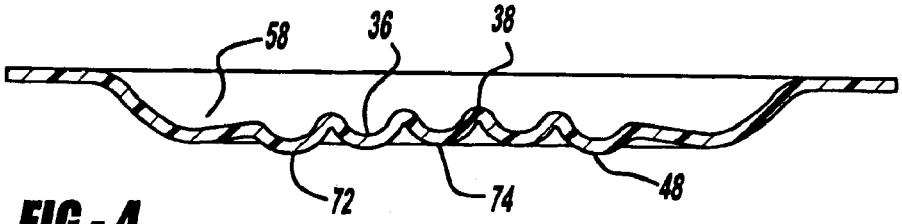
FIG. 4 is a cross-sectional view of the inverting vacuum panel, taken generally along the line 4—4 of FIG. 2, the inverting vacuum panel shown as formed on the container sidewall, the container as molded and empty.

Vacuum panels 32 further include an upper portion 60, a central portion 62 and a lower portion 64. The upper portion 60, the central portion 62 and the lower portion 64 are unitarily formed with one another and are formed generally in the shape of a compound curve. As illustrated in FIGS. 3 and 4, as molded, in cross section, the upper portion 60 and the lower portion 64 form generally concave surfaces 66 and 68. An apex 70 of each such concave surfaces 66 and 68 measures approximately between about 1.07 inches (27.178 mm) to about 1.47 inches (37.338 mm) from the central longitudinal axis 46 of the container 10. Similarly, as molded, in cross section, the central portion 62 forms a generally convex surface 72. An apex 74 of the convex surface 72 measures approximately between about 1.16 inches (29.464 mm) to about 1.56 inches (39.624 mm) from the central longitudinal axis 46 of the container 10.

Figure 5:
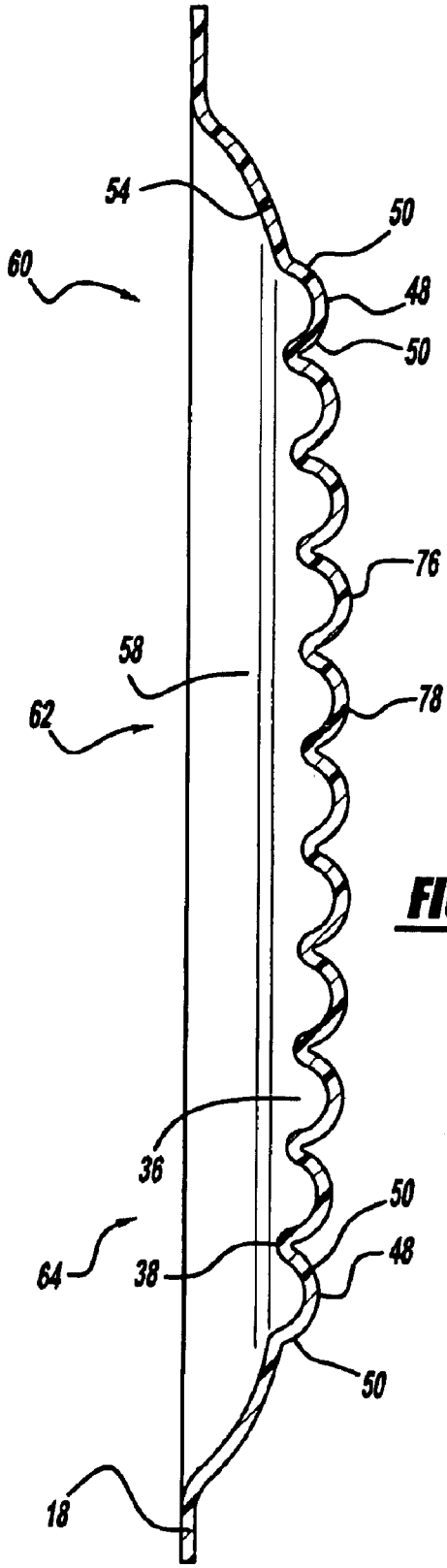
FIG. 5 is a cross-sectional view of the inverting vacuum panel, taken generally along the line 5—5 of FIG. 2, the inverting vacuum panel shown as formed on the container sidewall, the container being filled and sealed.
Figure 6:
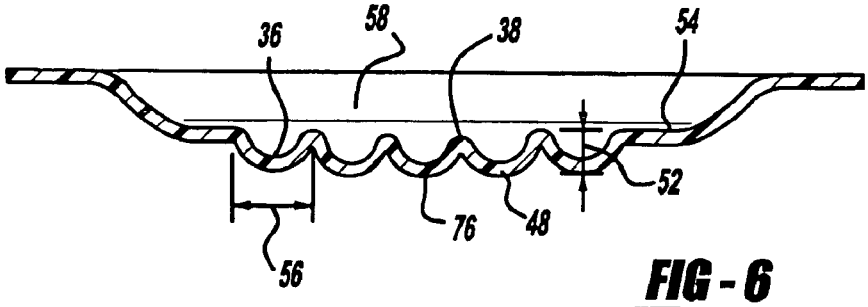
FIG. 6 is a cross-sectional view of the inverting vacuum panel, taken generally along the line 6—6 of FIG. 2, the inverting vacuum panel shown as formed on the container sidewall, the container being filled and sealed.

Upon filling, capping, sealing and cooling, as illustrated in FIGS. 5 and 6, the central portion 62, as well as the upper portion 60 and the lower portion 64 to a lesser extent, are pulled radially inward, toward the central longitudinal axis 46 of the container 10, displacing volume, as a result of vacuum forces. In this position, the upper portion 60, the central portion 62 and the lower portion 64 of the vacuum panel 32, in cross section, form a second concave surface 76. An apex 78 of the second concave surface 76 measures approximately between about 0.89 inches (22.606 mm) to about 1.39 inches (35.306 mm) from the central longitudinal axis 46 of the container 10. Accordingly, upon filling, capping, sealing and cooling, the concave surfaces 66 and 68, and to a lesser extent the convex surface 72, virtually disappear with the second concave surface 76 being generated in their place. All of the above dimensions were taken from a typical 20 ounce hot-fillable container having a radius of approximately 1.42 inches (36.068 mm). It is contemplated that comparable dimensions are attainable for containers of varying shapes and sizes.

The greater the difference between the measurement from the apex 74 to the central longitudinal axis 46, and the measurement from the apex 78 to the central longitudinal axis 46, the greater the achievable displacement of volume. Said differently, the greater the inward radial movement between the apex 74 and the apex 78, the greater the achievable displacement of volume. Deformation of the sidewall portion 18 is avoided by controlling and limiting the deformation to the vacuum panels 32. Accordingly, the thin, flexible, generally compound curve geometry of the vacuum panels 32 of the sidewall portion 18 of the container 10 allows for greater volume displacement versus containers having a semi-rigid sidewall portion.

Figure 7:
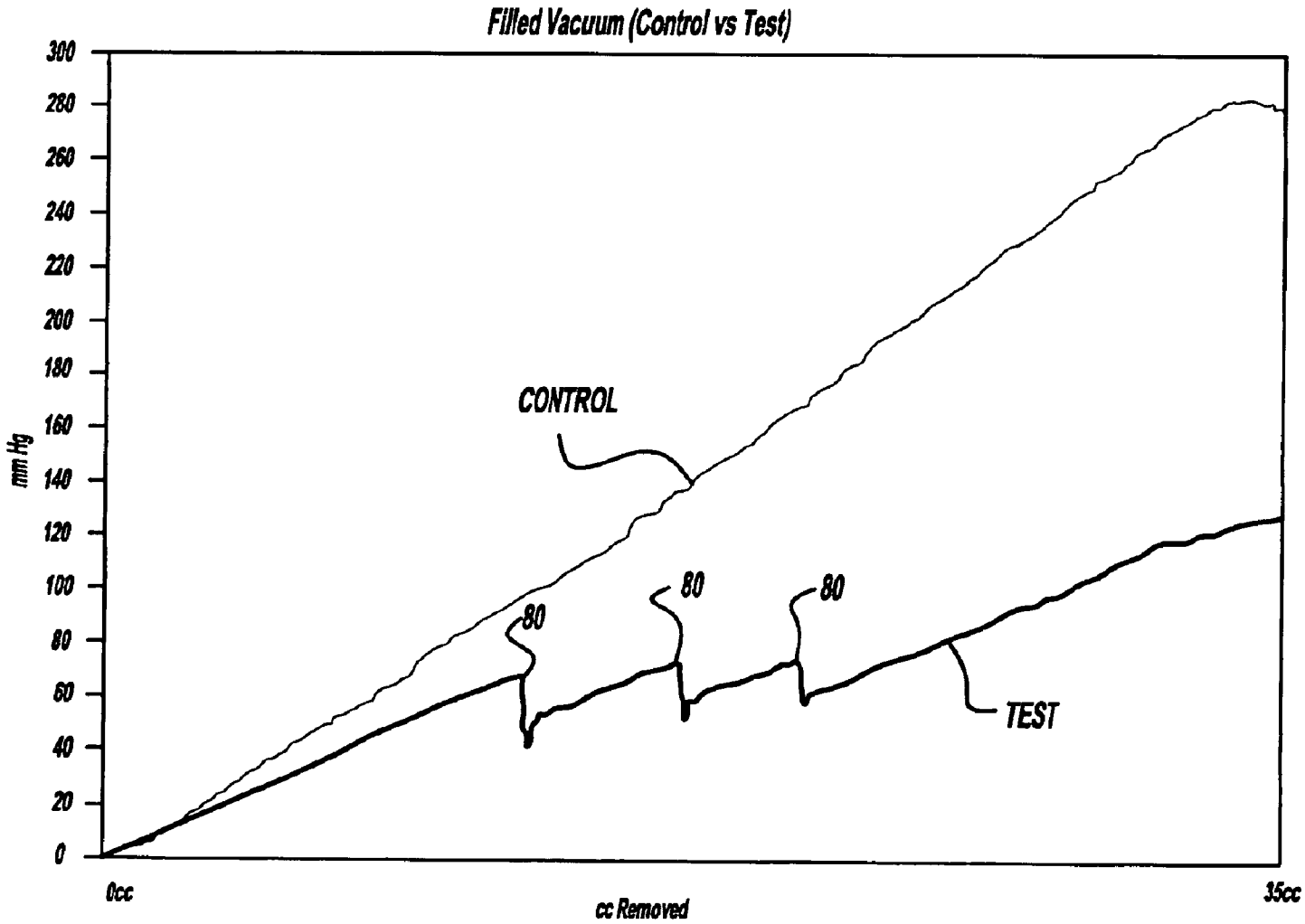
FIG. 7 is a chart comparing the vacuum pressures of a current stock container with that of a container embodying the principles of the present invention.

Referring now to the chart illustrated in FIG. 7, the significant benefit of the present invention through the reduction of vacuum pressure is exhibited. As previously discussed, the less vacuum pressure the container is subjected to, the greater the ability to lightweight the container. As illustrated, the current stock control container exhibits a maximum vacuum pressure of approximately 280 mm Hg. While for the same amount of volume displacement, the container 10 having vacuum panels 32 exhibits a maximum vacuum pressure of approximately 100 mm Hg. Accordingly, as is shown in FIG. 7, the container 10 having vacuum panels 32 can displace the same amount of volume as the current stock control container at a significantly lower vacuum pressure thus allowing for the container 10 having vacuum panels 32 to be significantly lightweighted. The test data exhibited in FIG. 7 is associated with a container having three (3) vacuum panels 32. Each vacuum panel 32 offers a reduction in vacuum pressure. The three (3) significant drops in vacuum pressure from peaks 80 correspond to each vacuum panel 32 separately deflecting radially inward. As each vacuum panel 32 defects radially inward, the amount of vacuum pressure is shown to drop significantly.

Figure 8:
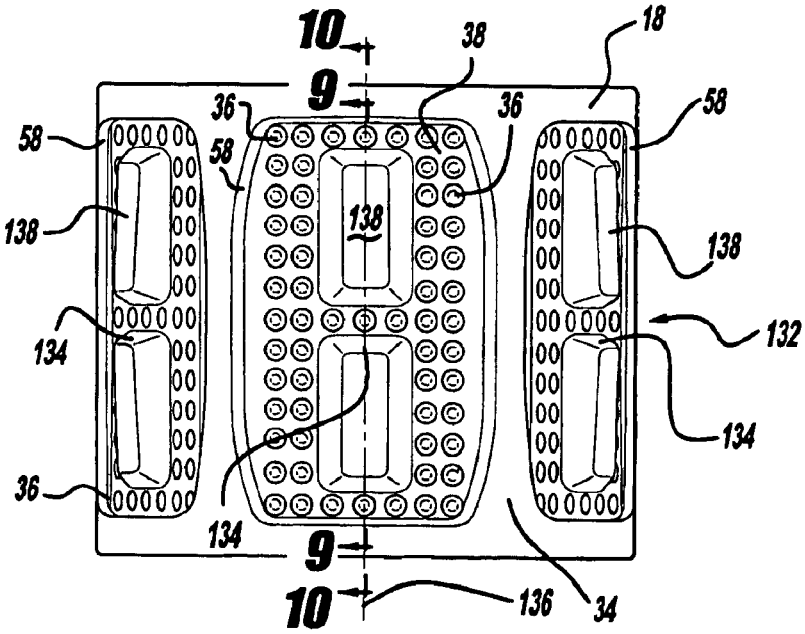
FIG. 8 is an elevational view of one of the inverting vacuum panels of an alternative embodiment of the present invention.
Figure 9:
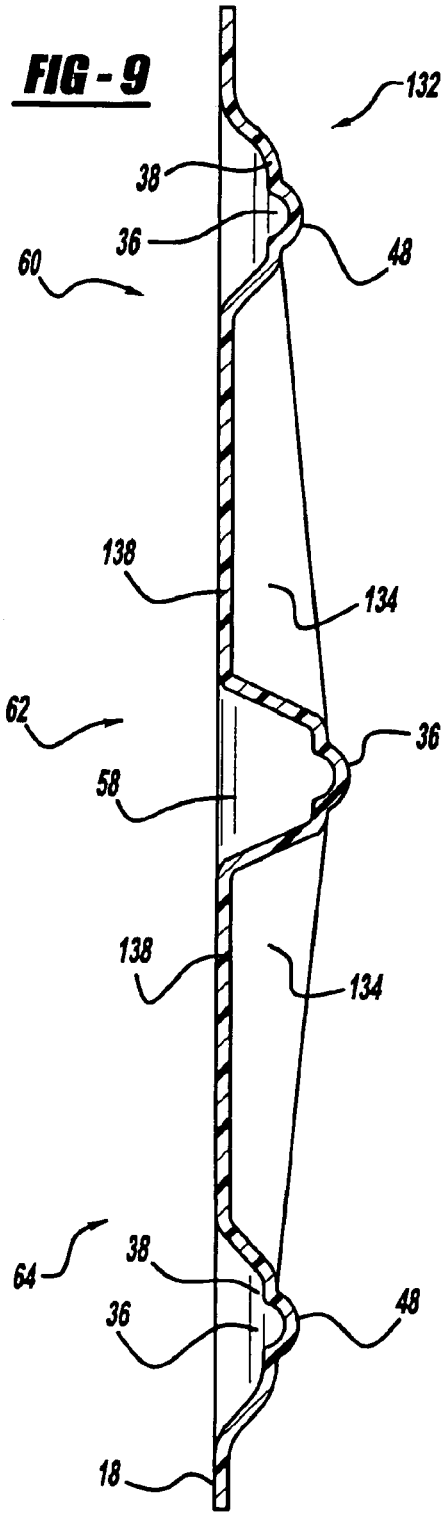
FIG. 9 is a cross-sectional view of the inverting vacuum panel, taken generally along the line 9—9 of FIG. 8, the inverting vacuum panel shown as formed on the container sidewall, the container being filled and sealed.
Figure 10:
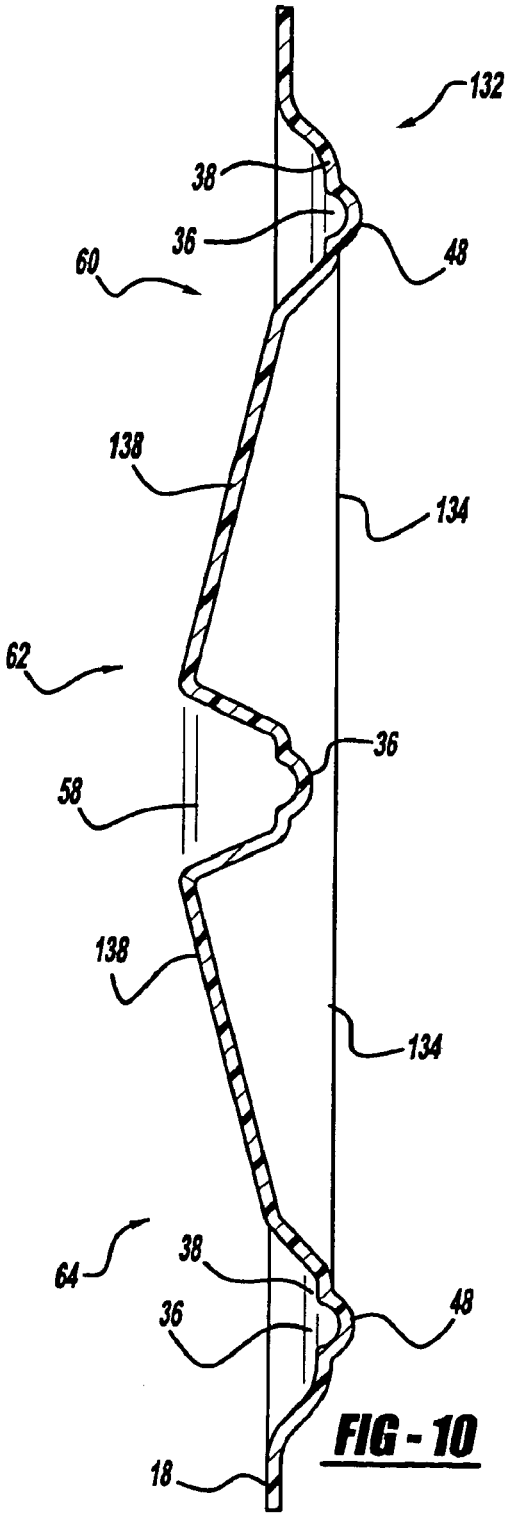
FIG. 10 is a cross-sectional view of the inverting vacuum panel, taken generally along the line 10—10 of FIG. 8, the inverting vacuum panel shown as formed on the container sidewall, the container as molded and empty.

FIGS. 8, 9 and 10 illustrate an alternate embodiment 132 of a vacuum panel according to the invention. Like reference numerals will be used to describe like components between the two embodiments. As with the previous embodiment of vacuum panels 32, the vacuum panels 132 include, but are not limited to, indents 36, lands 38, the perimeter wall or edge 58, the upper portion 60, the central portion 62 and the lower portion 64. The vacuum panels 132 differ primarily from the previous embodiment of vacuum panels 32 in that they include islands 134.

The islands 134 are located generally on a central longitudinal axis 136 of the vacuum panel 132. While two islands 134 are shown in the figures, it is contemplated that less than or more than this amount can be utilized. The islands 134, in cross section, are generally trapezoidal in shape having an upper surface 138. The islands 134 offer further support for container labels. Accordingly, as illustrated in FIG. 9, when the vacuum panel 132 is fully inverted, the upper surface 138 of the islands 134 is level with the outer label surface of the sidewall portion 18 of the container 10 so as to offer additional support for the container label. Similarly, as illustrated in FIGS. 8 and 10, when the vacuum panel 132 is not fully inverted, when the container 10 is molded and empty, the upper surface 138 of the islands 134 is not level with the outer surface of the sidewall portion 18 of the container 10.

While the above description constitutes the preferred embodiment of the present invention, it will be appreciated that the invention is susceptible to modification, variation and change without departing from the proper scope and fair meaning of the accompanying claims.

What is claimed is:

1. A sidewall portion of a plastic container adapted for vacuum absorption, the container having an upper portion including a mouth defining an opening into the container, a lower portion forming a base, and the sidewall portion connected with and extending between the upper portion and the lower portion; the upper portion, the lower portion and the sidewall portion cooperating to define a receptacle chamber within the container into which product can be filled; said sidewall portion comprising a plurality of generally rectangular shaped vacuum panels formed therein, said vacuum panels defined in at least part by an upper portion, a central portion, a lower portion and a series of generally circular indents formed therein and throughout said upper portion, said central portion and said lower portion; said upper portion, said central portion and said lower portion of said vacuum panels combine to form a compound curve, said vacuum panels being movable to accommodate vacuum forces generated within the container thereby decreasing the volume of the container.

2. The sidewall portion of claim 1 wherein said series of indents are arranged in horizontal rows and vertical columns.

3. The sidewall portion of claim 2 wherein material is thickest at a bottom portion of said indent and is thinnest at an area between said indents.

4. The sidewall portion of claim 1 wherein a first dimension of a depth of said indent is equal to a second dimension of a length of said indent.

5. The sidewall portion of claim 1 wherein said vacuum panels further include a central longitudinal axis and at least two islands located thereon.

6. A sidewall portion of a plastic container adapted for vacuum absorption, the container having an upper portion including a mouth defining an opening into the container, a lower portion forming a base, and the sidewall portion connected with and extending between the upper portion and the lower portion; the upper portion, the lower portion and the sidewall portion cooperating to define a receptacle chamber within the container into which product can be filled; said sidewall portion comprising a plurality of generally rectangular shaped vacuum panels formed therein, said vacuum panels having a perimeter wall, an upper portion, a central portion, a lower portion and a plurality of generally circular indents formed therein and throughout said upper portion, said central portion and said lower portion; said perimeter wall being adjacent to and generally surrounding said upper portion, said central portion and said lower portion; said upper portion and said lower portion forming a first generally concave shaped surface in cross section and said central portion forming a generally convex shaped surface in cross section, said vacuum panels being movable to accommodate vacuum forces generated within the container thereby decreasing the volume of the container.

7. The sidewall portion of claim 6 wherein said upper portion, said central portion and said lower portion combine to form a second generally concave shaped surface in cross section when the container is filled and sealed.

8. The sidewall portion of claim 7 wherein said plurality of indents are arranged in horizontal rows and vertical columns.

9. The sidewall portion of claim 8 wherein material is thickest at a bottom portion of said indent and is thinnest at an area between said indents.

10. The sidewall portion of claim 7 wherein a first dimension of a depth of said indent is equal to a second dimension of a length of said indent.

11. The sidewall portion of claim 7 wherein said vacuum panels further include a central longitudinal axis and at least two islands projecting therefrom.

12. A sidewall portion of a plastic container adapted for vacuum absorption, said sidewall portion comprising:

a plurality of vacuum panels formed in said sidewall portion; said vacuum panels having a series of generally circular indents formed therein, are generally rectangular in shape, and further include an upper portion, a central portion and a lower portion; said upper portion and said lower portion forming a first generally concave shaped surface in cross section and said central portion forming a generally convex shaped surface in cross section, said vacuum panels being inwardly movable along a radial axis, said movement being in response to changes in pressure in the container.

13. The sidewall portion of claim 12 wherein said upper portion, said central portion and said lower portion combine to form a second generally concave shaped surface in cross section when the container is filled and sealed.

14. The sidewall portion of claim 13 wherein said series of indents are arranged in horizontal rows and vertical columns.

15. The sidewall portion of claim 14 wherein material is thickest at a bottom portion of said indent and is thinnest at an area between said indents.

16. The sidewall portion of claim 15 wherein said vacuum panels further include a central longitudinal axis and at least two islands projecting therefrom.

17. A sidewall portion of a plastic container adapted for vacuum absorption, said sidewall portion comprising:

a plurality of generally rectangular shaped vacuum panels formed in said sidewall portion; said vacuum panels having an upper portion, a central portion, a lower portion and a series of indents formed therein arranged in horizontal rows and vertical columns; said upper portion and said lower portion forming a first generally concave shaped surface in cross section and said central portion forming a generally convex shaped surface in cross section; said vacuum panels being inwardly movable along a radial axis, said movement being in response to changes in pressure in the container such that said upper portion, said central portion and said lower portion combine to form a second generally concave shaped surface in cross section when the container is filled and sealed.

18. A sidewall portion of a plastic container adapted for vacuum absorption, the container having an upper portion including a mouth defining an opening into the container, a lower portion forming a base, and the sidewall portion connected with and extending between the upper portion and the lower portion; the upper portion, the lower portion and the sidewall portion cooperating to define a receptacle chamber within the container into which product can be filled; said sidewall portion comprising a plurality of generally rectangular shaped vacuum panels formed therein, said vacuum panels defined in at least part by an upper portion, a central portion, a lower portion and a series of generally circular indents formed therein and throughout said upper portion, said central portion and said lower portion; said upper portion and said lower portion forming a first generally concave shaped surface in cross section and said central portion forming a generally convex shaped surface in cross section, said vacuum panels being movable to accommodate vacuum forces generated within the container thereby decreasing the volume of the container.

19. The sidewall portion of claim 18 wherein said upper portion, said central portion and said lower portion combine to form a second generally concave shaped surface in cross section when the container is filled and sealed.

* * * * *